United States Patent [19]

Hockert et al.

[11] Patent Number: 5,056,797

[45] Date of Patent: Oct. 15, 1991

[54] DISK TOSS GAME

[76] Inventors: Tad L. Hockert, 507 S. Riverside, Goshen, Ind. 46526; Steven L. Hockert, 1059 E. Centennial, Nappanee, Ind. 46550

[21] Appl. No.: 662,438

[22] Filed: Feb. 28, 1991

[51] Int. Cl.[5] ..... A63B 63/00; A63B 67/06

[52] U.S. Cl. ..... 273/402

[58] Field of Search ..... 273/400, 401, 402

[56] References Cited

U.S. PATENT DOCUMENTS

| | | | |
|---|---|---|---|
| 922,717 | 5/1909 | Parker | 273/401 |
| 1,541,980 | 6/1925 | Luber | 273/401 X |
| 2,287,113 | 6/1942 | Markey | 273/401 |
| 3,628,793 | 12/1971 | Mudloff | 273/402 |
| 3,964,745 | 6/1976 | Ogg | 273/401 |
| 4,012,042 | 3/1977 | Blasingame | 273/401 |
| 4,243,229 | 1/1981 | Huser et al. | 273/402 |
| 4,877,256 | 10/1989 | Falloon | 273/400 |
| 4,943,065 | 7/1990 | Delapa | 273/402 |
| 4,968,041 | 11/1990 | Calvo | 273/401 |
| 4,974,858 | 12/1990 | Knowlton | 273/401 |

FOREIGN PATENT DOCUMENTS

| | | | |
|---|---|---|---|
| 361147 | 11/1931 | United Kingdom | 273/402 |

*Primary Examiner*—William H. Grieb

[57] ABSTRACT

A disk tossing game in which a target board is oriented essentially horizontally, but with a slight upward tilt in a front-to-rear direction. The target board surface is formed by a layer of soft foam material, such that a tossed disk landing on the target surface tends to remain at its initial landing point rather than rebounding away from the target surface.

6 Claims, 1 Drawing Sheet

DISK TOSS GAME

BACKGROUND AND SUMMARY OF THE INVENTION

This invention relates to a game that involves tossing a disk onto an essentially horizontal target surface containing at least one target hole therein. The object of the game is to toss a disk into the target hole or onto adjacent areas of the target surface that have values (points) marked thereon. The winner is the perso (or team) that accumulates the most points after a predetermined number of tosses, or the person that first achieves a predetermined number of points.

U.S. Pat. No. 4,877,256 to D. Falloon shows a tossing game wherein annular disks or rings are thrown toward a target device located on a ground or floor surface. The target device comprises a relatively large upstanding box or tray. Three relatively small upright tubes of graduated height are arranged within the box. The object of the game is to land a disk in the tallest cup, or in the alternative, the other cups or box area surrounding the cups.

One disadvantage of the game shown in U.S. Pat. No. 4,877,256 is that when the disk strikes the edge of a cup or the upper edge of the box it is apt to rebound away from the target device. The game tends to reward the lucky player, not the player with the most skill.

The present invention contemplates a disk tossing game wherein the target surface is formed by a flat soft cushioner pad having at least one target hole therein. When a disk is thrown onto the cushioner pad it tends to stay on the pad surface, rather than rebounding off the target. The cushioner pad is comprised of a layer of soft non-rigid resilient foam material that tends to deflect when impacted by a thrown disk. Deflection of the foam pad material absorbs at least some of the kinetic energy of the disk, thereby keeping the disk on the pad.

The target is constructed so that the foam cushioner pad is tilted at about ten degrees from the horizontal, with the rear edge of the pad being higher than the front edge. Forward momentum of a disk striking the pad is at least partly counteracted by the tilted pad surface. Should the disk rebound from the pad surface it will tend to move essentially straight up (i.e. vertically) rather than continuing in a forward direction dictated by its forward momentum.

An aim of the invention is to provide a game having a target surface tending to cause a tossed disk to stay on, or at least close to, its initial landing point on the target surface.

THE DRAWINGS

DESCRIPTION OF A PREFERRED EMBODIMENT OF THE INVENTION

Figure 7:
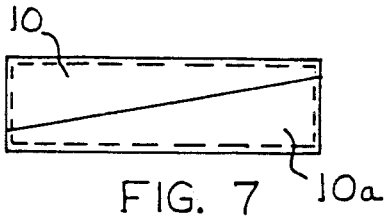
FIG. 7 is a side elevational view of two target devices placed together for display or compact shipment.

The drawings show a game comprised of two target devices 10 and 10*a* (FIG. 7). The devices are similarly sized and constructed; therefore the description will be directed primarily to target device 10. The description will apply also to target device 10*a*.

Target device 10 comprises a flat target board 11 having a square configuration defined by front edge 13, rear edge 15, and two side edges 17. A short front wall 19 extends downwardly from front edge 13 of board 11; similarly, a somewhat longer rear wall 21 extends downwardly from rear edge 15, and two side walls 23 extend downwardly from side edges 17 of the board. The various walls 19, 21 and 23 have lower edges thereof terminating in a common plane for supporting board 11 in a tilted condition above a floor or ground surface 25. The tilt angle is preferably about ten degrees.

At a central point on board 11 there is a circular target hole 27. A number of interchangeable cushioner pads 29, 30 or 31 (FIGS. 2, 3 and 4) are adapted for placement on the upper face of target board 11. Each cushioner pad has a central hole therethrough alignable with target hole 27. The central hole in pad 29 is designated by numeral 33; the central holes in pads 30 and 31 are designated by numerals 35 and 37.

Figure 2:
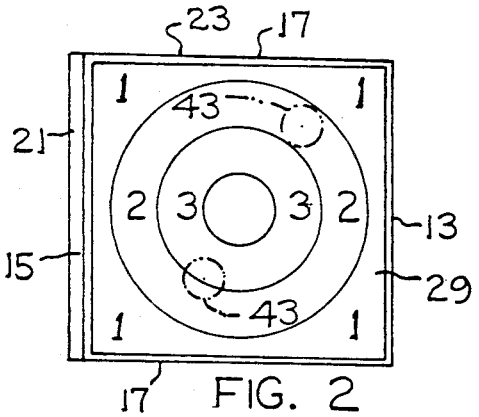
FIG. 2 is a top plan view of the FIG. 1 target device.
Figure 3:
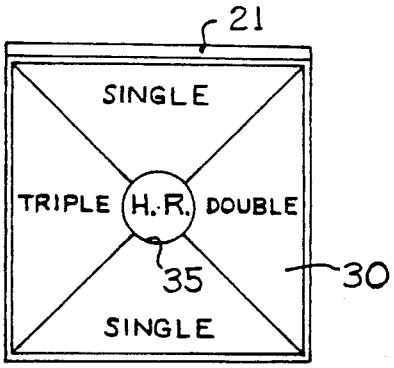
FIGS. 3 and 4 are views taken in the same direction as FIG. 2, but showing different target surfaces that can be used for playing different variations of the game.
Figure 5:
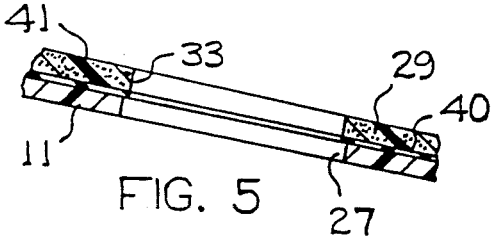
FIG. 5 is a fragmentary enlarged sectional view taken through the target surface in the FIG. 1 device.
Figure 4:
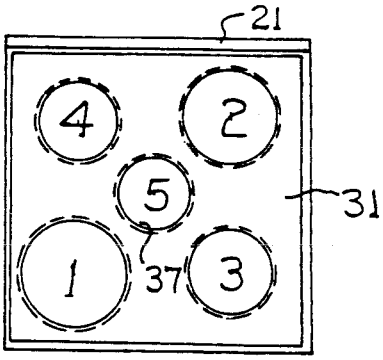
Figure 6:
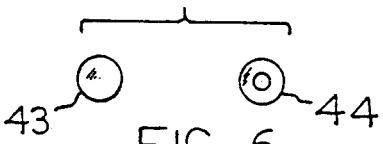
FIG. 6 illustrates two types of disks that can be used when playing the game.

Each cushioner pad 29, 30 and 31 has the same size and construction, the difference being the target markings on the pad upper face. The pad of FIG. 2 is marked with concentric circles that circumscribe areas having different point values. The pad of FIG. 3 is marked to designate different target areas associated with baseball. The pad of FIG. 4 is marked to show five different discrete circular targets of different size; the five target areas in the FIG. 4 pad may be circular holes, in which case the subjacent target board 11 will have holes in corresponding locations.

A feature of this invention is the construction of each cushioner pad 29, 30 or 31. In each case, the pad includes a lower layer 40 of rubber adapted to seat on the upper face of board 11, and an upper layer 41 of resilient foam material, e.g. soft foam rubber or soft foamed plastic. Lower layer 40 is relatively thin. Upper layer 41 is much thicker, at least about one fourth inch thick. Rubber layer 40 tends to stick or adhere to the surface of board 11, thereby preventing any slippage of the cushioner pad off of board 11. The cushioner pad can however, be lifted off of the board for replacement or storage purposes.

The game is played by two or more players taking turns throwing flat circular disks onto the cushioner pads 29, 30 or 31 (depending on the type of game being played). Usually two target devices 10 and 10*a* will be used, although it is possible to play the game with only one target device.

When two target devices are used, such target devices are placed on a floor or ground surface in spaced-apart relation. Typically the target devices will be spaced about fifteen feet apart. A player standing near one of the target devices throws each disk toward the other target device; usually an underhand motion is employed, similar to the motion used to throw pennies toward a wall. The disks can be flat imperforate circular steel disks; alternately the disks can have holes therethrough. Numeral 43 designates an imperforate disk, whereas numeral 44 designates a perforated disk. Each disk has a preferred diameter, ranging from about two and one half inches to about three inches. The diameter of the central target hole in each pad 29, 30 or 31 is preferably about twice the disk diameter.

Figure 1:
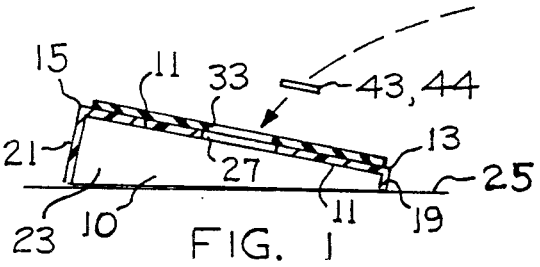
FIG. 1 is a sectional view taken through a target device embodying features of the invention.

The soft foam cushioner pad surface 41 forms an important feature of the game. When a disk impacts the foam surface at least some of the kinetic energy in the disk is absorbed by the foam material. The disk therefore tends to stay on the spot where it lands. Another factor tending to keep the disk from rebounding away from the target surface is the tilted attitude of the target board 11. Any disk rebounding from the foam surface tends to rebound backwards (to the right in FIG. 1), due to the titled attitude of board 11. The action counteracts the forward (leftward) momentum of the disk, such that the disk has a tendency to move vertically and then drop down on or near its initial landing point.

FIG. 7 shows two of the target devices 10 and 10*a* juxtaposed into a hollow box configuration that is useful for compact shipment or stacking on the store shelf at the point of sale. The disks and cushioner pads can be stored in the hollow box structure.

What is claimed is:

1. A game comprising at least one target device adapted for positionment on a floor or ground surface; and a series of flat circular disks to be thrown by the game players onto each said target device; each said target device comprising a flat target board having a front edge, a rear edge, and two side edges; each target board having at least one target hole therein; each target board being tilted in a front-to-rear direction so that the rear edge is slightly higher than the front edge; a number of interchangeable cushioner pads adapted for disposition on each said target board; each cushioner pad comprising a multi-layer structure that includes a rubber layer adapted to cling to the target board surface; and a soft resilient foam layer bonded to said rubber layer so that when the pad is positioned on a target board any disk landing flatwise on the pad will tend to stay on the resilient foam surface instead of bouncing off of the foam surface; each pad having at least one hole therethrough alignable with the hole in the associated target board.

2. The game of claim 1, wherein each target board has a square configuration so that all four edges of the board have the same length; each target device including a front wall extending angularly from the front edge of the board, a rear wall extending angularly from the rear edge of the board, and two side walls extending angularly from the side edges of the board; said walls having exposed edges thereof terminating in a common plane for supporting the board in a titled condition on a floor or ground surface.

3. The game of claim 2, wherein the front wall of each target device is shorter than the rear wall so that the target board is tiltable at an angle of approximately ten degrees.

4. The game of claim 3, wherein there are two target devices similarly sized so that the walls of the two devices can have edge contact to form a hollow box structure.

5. The game of claim 1, wherein each cushioner pad has a thickness of at least on quarter inch.

6. The game of claim 1, wherein said target hole is located on the geometric center of the target board.

* * * * *